US007549379B2

(12) United States Patent
Monaco et al.

(10) Patent No.: US 7,549,379 B2
(45) **Date of Patent: *Jun. 23, 2009**

(54) RAILWAY FREIGHT CAR SIDE BEARING

(75) Inventors: Jay Monaco, Glen Carbon, IL (US); Bradford Johnstone, Plainfield, IL (US)

(73) Assignee: AMSTED Rail Company, Inc, Granite City, IL (US)

( * ) Notice: Subject to any disclaimer, the term of this patent is extended or adjusted under 35 U.S.C. 154(b) by 224 days.

This patent is subject to a terminal disclaimer.

(21) Appl. No.: 11/488,269

(22) Filed: Jul. 19, 2006

(65) Prior Publication Data

US 2008/0035012 A1 Feb. 14, 2008

(51) Int. Cl.
*B61F 3/00* (2006.01)

(52) U.S. Cl. ..... 105/199.3; 105/199.4

(58) Field of Classification Search ..... 105/199.3, 105/19.49

See application file for complete search history.

(56) References Cited

U.S. PATENT DOCUMENTS 7,121,212 B2 * 10/2006 Schorr et al. ..... 105/199.3
2004/0187726 A1 * 9/2004 Schorr et al. ..... 105/199.3
2005/0087092 A1 * 4/2005 McKisic et al. ..... 105/199.3
2006/0042498 A1 * 3/2006 Schorr et al. ..... 105/199.3
2008/0035012 A1 * 2/2008 Monaco et al. ..... 105/199.3
2008/0035013 A1 * 2/2008 Johnstone et al. ..... 105/199.3
2008/0115690 A1 * 5/2008 Mitchell et al. ..... 105/199.3
2008/0173211 A1 * 7/2008 Kennedy ..... 105/199.3

* cited by examiner

*Primary Examiner*—S. Joseph Morano
*Assistant Examiner*—Jason C Smith
(74) *Attorney, Agent, or Firm*—Edward J. Brosius

(57) ABSTRACT

A long travel constant contact side bearing for railway cars provides better handling characteristics, achieving improved tracking and curving through use of various combinations of features. The side bearing comprises a base and a generally cylindrical wall section extending upwardly from the base. A cup-shaped cap comprises a generally circular top section and a generally cylindrical wall section extending downwardly therefrom. The cap extends into the wall section of the base. At least one coil spring is provided within the base and extends to the underside of the cap. The cup shaped cap includes a centrally located cut out section with an elastomer pad fitted within the cut out section. The cup shaped cap cylindrical wall sections can be coated with a lubricant or hardening substance.

24 Claims, 6 Drawing Sheets

RAILWAY FREIGHT CAR SIDE BEARING

BACKGROUND OF INVENTION

The present invention related to an improved side bearing for mounting on a railroad car truck bolster that allows long travel, substantial weight reduction, improved hunting and curving characteristics, longer service life and various ease of installation features.

In a typical railway freight train, such as that shown in FIG. 1, railway cars 12, 14 are connected end to end by couplers 16, 18. Couplers 16, 18 are each received in draft sills 20, 22 of each respective car along with hydraulic cushioning or draft gear assemblies (unshown). Draft sills 20, 22 are provided at the ends of the railway car's center sill, and include center plates that rest in center plate bowls of railway car trucks 26, 28.

As better shown in FIG. 2, each typical car truck 26 includes a pair of side frames 30, 32 supported on wheel sets 34, 36. Bolster 38 extends between and is supported on springs 40 mounted on side frames. A bolster center plate 24 is provided having a central opening 42. The bolster center plate bowl 24 received and supports a circular center plate of the draft sill 20. Side bearing pads 60 are provided laterally to each side of center plate 24 on bolster 38. Side frames 30, 32 comprise a top member 44, compression member 46, tension member 48, column 50, gib 52, pedestal 54, pedestal roof 56, bearings 58 and bearing adapter 62.

Constant contact side bearings are commonly used on railroad car trucks. They are typically located on the truck bolster, such as on side bearing pads 60, but may be located elsewhere. Some prior designs have used a single helical spring mounted between a base and a cap. Others use multiple helical springs or elastomer elements. Exemplary known side bearing arrangements include U.S. Pat. No. 3,748,001 to Neumann et al and U.S. Pat. No. 4,130,066 to Mulcahy.

Typical side bearing arrangements are designed to control hunting of the railroad car. That is, as the semi-conical wheels of the railcar truck ride along a railroad track, a yaw axis motion is induced in the railroad car truck. As the truck yaws, part of the side bearing is made to slide across the underside the wear plate bolted to the railroad car body bolster. The resulting friction produces an opposing torque that acts to prevent this yaw motion. Another purpose of railroad car truck side bearings is to control or limit the roll motion of the car body. Most prior side bearing designs limited travel of the bearings to about 5/16". The maximum travel of side bearings is specified by the Association of American Railroads (AAR) standards. Previous standards, such as M-948-77, limited travel to 5/16" for many applications.

New standards have evolved requiring side bearings that have improved hunting, curving and other properties to further increase the safety and design of railcars. The most recent AAR standard is M-976 that now allows for longer travel side bearings and has several new requirements, such as new specifications for bearing preloads. Preload is defined as the force applied by the spring element when the constant contact side bearing is set at the prescribed height.

Under certain conditions, undesirable wear is caused to the railroad car body bolster due to contact with the side bearings. Further, undesirable wear may occur within the side bearing itself when two metallic components are moving in contact with each other.

SUMMARY OF THE INVENTION

There is a need for improved side bearings for railroad cars that can meet or exceed these new AAR standards, such as M-976 or Rule 88 of the AAR Office Manual, and M-948 for side bearings.

There also is a need for side bearings with better wear characteristics to increase service life.

There further is a need for side bearings that can be designed for a particular application by incorporating design features that prevent interchangeability of incorrect components for that application.

There also is a need for a side bearing having improved wear characteristics in contacting the freight car body bolster.

There also is a need for a standardized set of springs that can reduce parts inventories of various custom spring sizes.

The above and other advantages are achieved by various embodiments of the invention.

In exemplary embodiments, long travel can be achieved in a side bearing arrangement for railroad car trucks by a combination of features, including reduction of base and/or cap heights and/or reduction of the spring solid height to accommodate 5/8" travel or more before the spring is fully compressed (solid) and before the base and cap bottom out.

In exemplary embodiments, substantial weight reduction is achieved by reducing sides and thicknesses of the base and cap in areas not needed for structural rigidity.

In exemplary embodiments, non-metallic inserts are provided in the flat top surface of the cap of the side bearing to reduce wear contact with the freight car body bolster.

In exemplary embodiments, non-metallic coatings are applied to the outer surface of the cap of the side bearing to reduce wear in the side bearing.

In exemplary embodiments, improved operation of the side bearing, including improved control and hunting characteristics, is achieved by careful control of longitudinal clearances between the cap and base. This has been found to be important to prevent excessive movement between the cap and base, as well as reduce associated impact forces, stresses and wear.

BRIEF DESCRIPTION OF THE DRAWINGS

The invention will be described with reference to the following drawings, wherein.

DETAILED DESCRIPTION OF THE PREFERRED EMBODIMENTS

Figure 1:
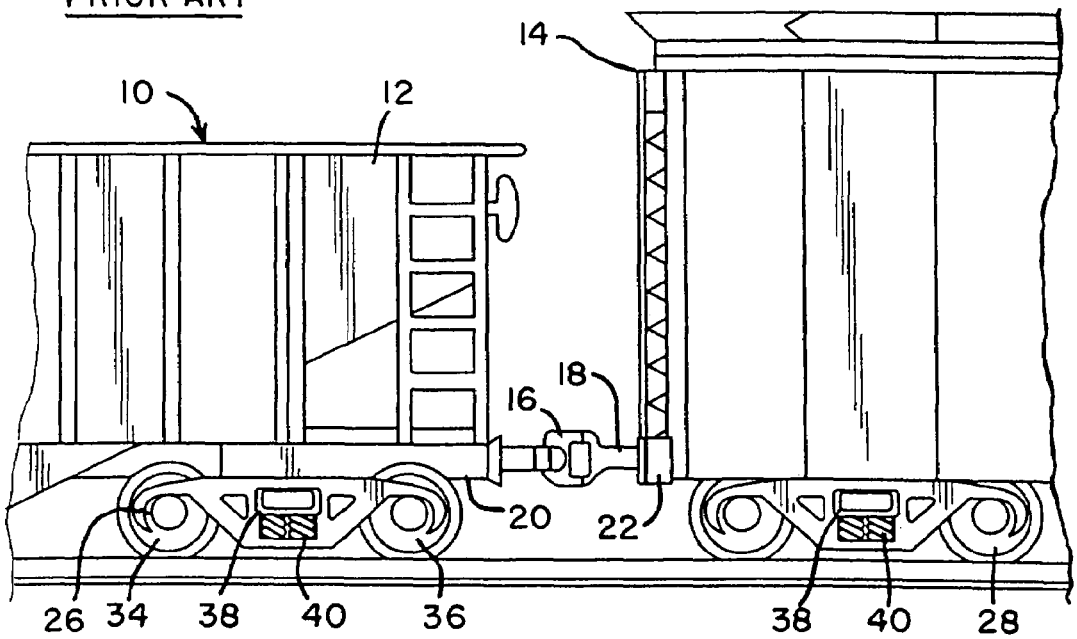
FIG. 1 PRIOR ART
FIG. 1 is a schematic elevation of the coupled ends of two typical railroad cars.
Figure 2:
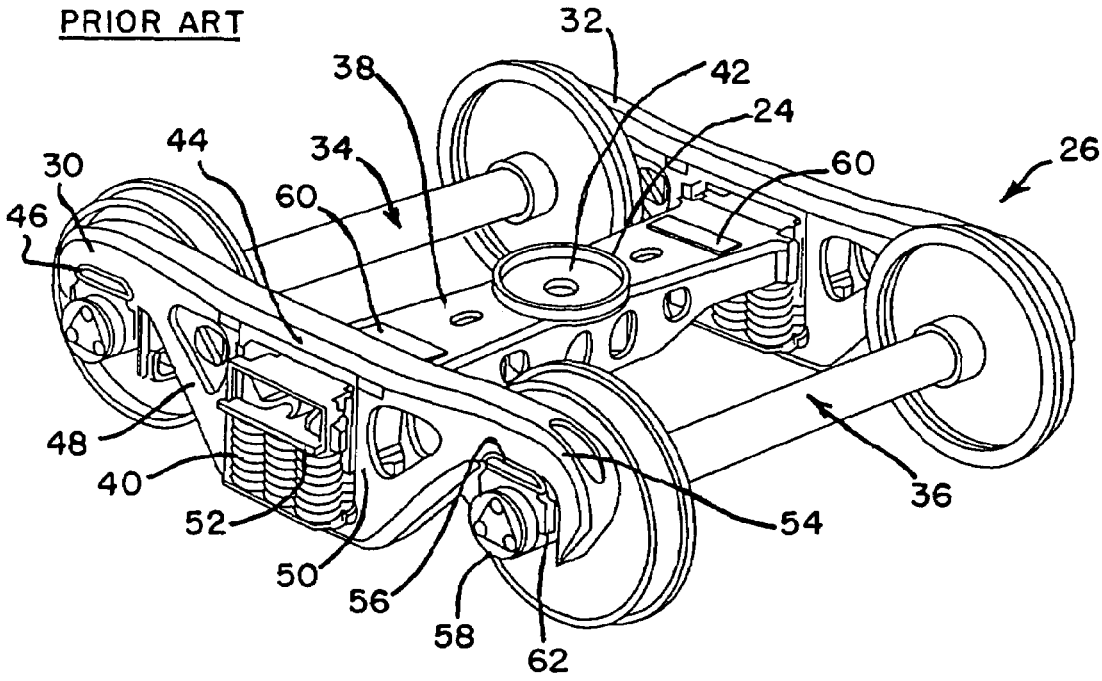
FIG. 2 PRIOR ART
FIG. 2 is a perspective view of a typical railway car truck for use with the present invention.
Figure 3:
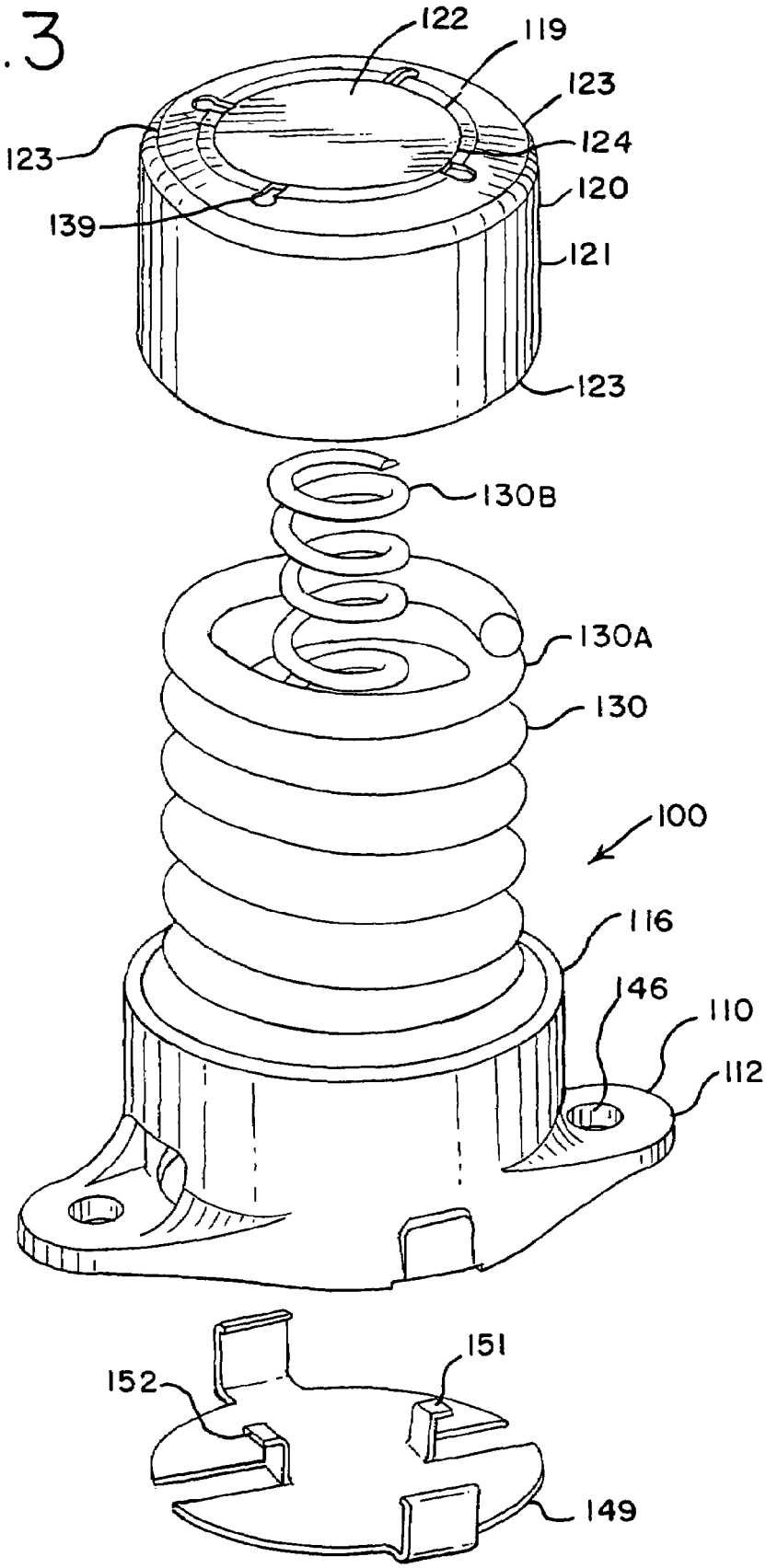
FIG. 3 is an exploded perspective view of an exemplary constant contact side bearing according to the invention.

A first embodiment of a side bearing according to the invention will be described with reference to FIGS. 3-10. Side bearing assembly 100 has a major longitudinal axis coincident with the longitudinal axis of a railway car. That is, when the side bearing is mounted on railway truck bolster 38, the major axis of the side bearing is perpendicular to the longitudinal axis of the bolster. Side bearing assembly 100 includes as main components, a base 110, a cap 120, and one or more resilient urging elements 130, such as a spring or elastomer element, and spring base 131. In the exemplary embodiment shown, there are provided two springs, outer spring 130A, and inner spring 130B that serve as the urging element, each of which may have a different spring constant to provide an overall combined load rating.

Base 110 is fixed to bolster 38 by suitable means. As shown, base 110 is bolted to bolster 38 by way of mounting bolts (not shown) passing through mounting holes 146 provided on base flanges 112.

As best shown in FIGS. 3 & 4, and 6-8, base 110 has generally open cylindrical wall 116 that extends upwardly from base 110. Wall 116 may include two openings 114. Opening 114 serves as an opening for the head of a wrench used to tighten the bolts passing through bolt holes 146. Opening 114 also serves to reduce weight of the base 110.

To increase the travel length of the side bearing, walls 116 are reduced in total height by 5/16" from prior designs, such as that used in U.S. Pat. No. 3,748,001. This helps to achieve greater travel of the spring before cap 120 and base 110 mate and prevent further travel. In an exemplary embodiment, base 110 has a total height of about 4.188 in. (+/−0.030), with walls 116 extending approximately 3.626 in. above flange 112.

Figure 4:
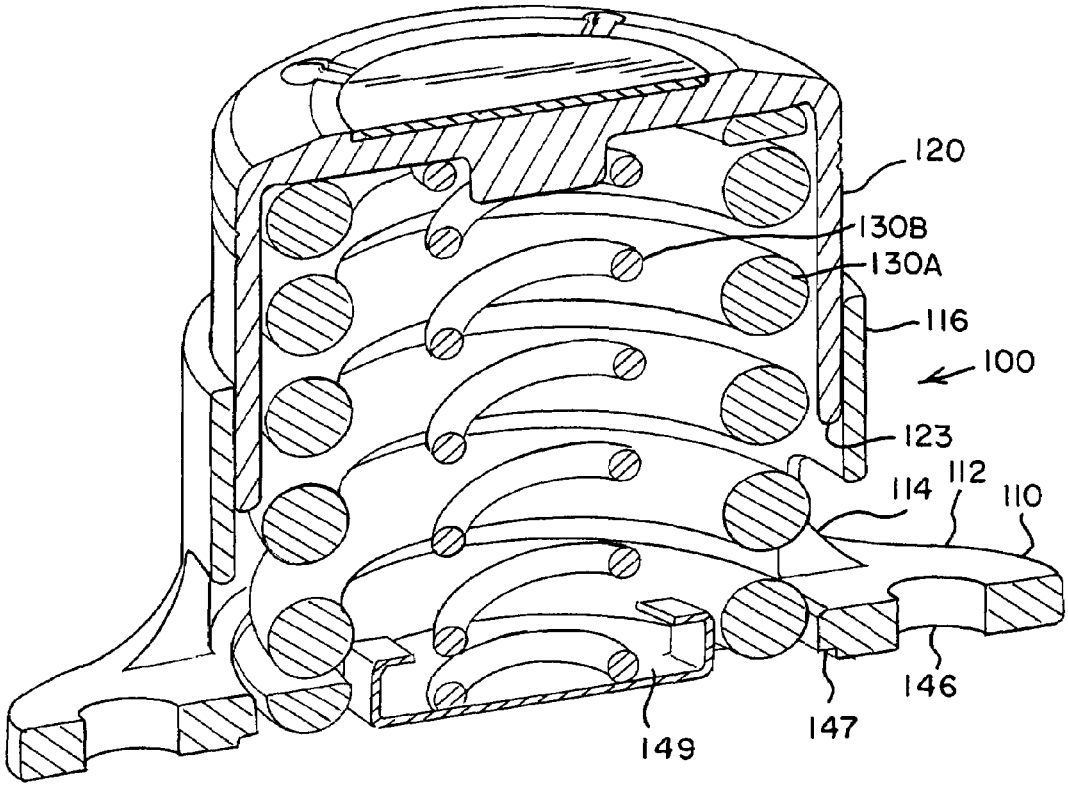
FIG. 4 is a cross-sectional view of an exemplary constant contact side bearing according to the invention.
Figure 4A:
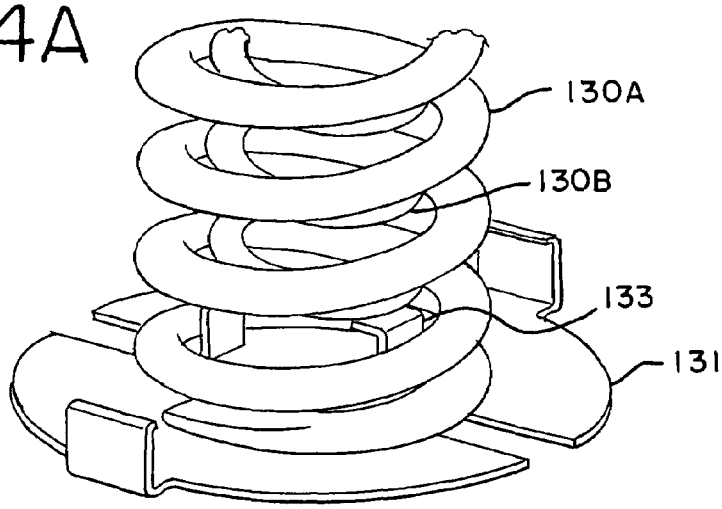
FIG. 4A is a partial detailed view of the coil springs and spring base of an embodiment of the present invention.
Figure 4B:
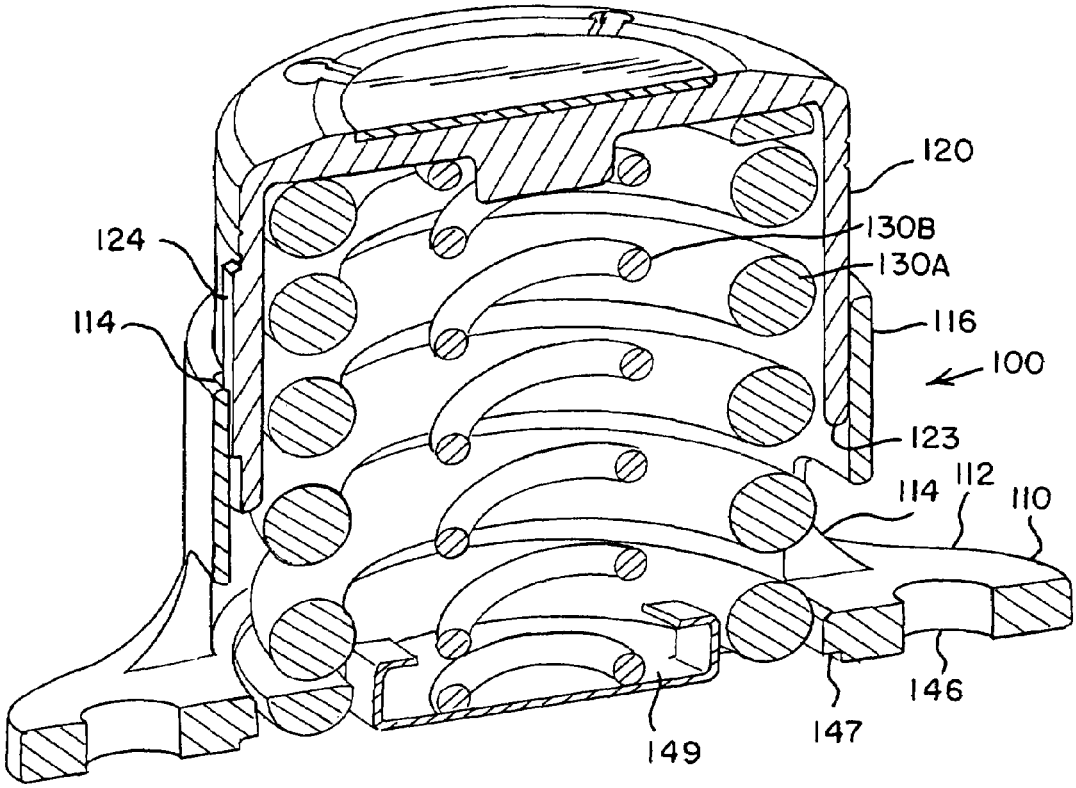
FIG. 4B is a cross-sectional view of an exemplary constant contact side bearing according to the present invention.

Referring to FIGS. 3&4 and 9-10, cap 120 is cup-shaped and includes generally circular top section 119 downwardly extending general cylindrical side walls 121, that enter base 110 open wall 116 in a telescoping fashion. As shown in FIG. 4B, cap side walls 121 can include a protruding ridge 124 on side wall 121 that can be U or V shaped corresponding in location with opening 114 on an inner surface of base wall 116 to restrict or prohibit the rotation of cap 120 in base 110. The downwardly extending side wall 121 of cap 120 extends into wall 116 of base 110 in such a fashion that even when the spring(s) 130 are at their free height or in an uncompressed condition, there is still provided an amount of overlap between side wall 121 and cylindrical wall 116.

Cap 120 is further provided with a top contact surface 128, lower stop edge 123, and lower recessed spring support surface 127. Preferably, all peripheral edges 129 are coped or rounded with a scoped or flat transition area 129A extending from top contact surface 128 to edge 129. This serves several purposes. It reduces weight of the cap. Moreover, by coping the corners, there is a better contact surface is made that abuts against a car body wear plate (unshown but located on the underside of a car body immediately above cap 120 in use). In particular, by having coped corners, it has been found that less gouging occurs on the car body wear plate when the cap slides and rotates in frictional engagement with the car body wear plate during use. To further assist in a better contact surface, top contact surface 128 is formed substantially flat, preferably within 0.010" concave or 0.030" convex to further improve wear characteristics. In particular, this bias reduces the chance of the edge "binding" against the wear plate and is easier to manufacture.

Further, in order to improve the wear of cap 120 top contact surface 128 against a freight car body bolster, top contact surface 128 includes a generally circular cut out section 119. Circular cut out section or well 119 is usually about 0.187 inch in depth. Further, a generally circular elastomer or other suitable non-metallic pad 122 is received in cut out section 119. Pad 122 is usually about 0.25 inch in thickness, so it typically protrudes from cut out section 119. Notches 129 can be provided around the edges of cut out section 119 to aid in the insertion of a tool to remove and replace elastomer pad 122. The actual depth of well 119 and the height of pad 122 are not critical; it is a part of the present invention that pad 122 protrudes above well 119.

Non-metallic elastomer pad 122 can be of several compositions. One such composition is a combination of carbon, rubber and strengthening fiber that is mold formed. Other non-metallic elastomeric compounds also would be operative.

Further, side walls 121 of cap 120 can be coated with a lubricant to reduce the wear of cap 120 within walls 116 of base 110. Such coating or sidewalls 121 can be a graphite lubricant impregnated into the metal surface or can be a hardening yet friction reducing coating such as titanium nitride. Similar coatings could be applied to the inside of walls 116 of base 110.

To assist in providing long travel of the springs, cap 120 is shortened similar to that of base 110. In an exemplary embodiment, cap 120 is shortened in height by 5/16" over previous designs to allow further travel of spring(s) 130 before cap 120 and base 110 mate and prevent further travel. Cap 120 preferably has a total cap height of 3.875 in., with side wall 121 extending downward approximately 3.375 in. below lower support surface 127. This allows the cap to insert farther onto base 110 before lower stop edge contacts the inside surface of base 110.

As mentioned, the inventive side bearing cap 120 and base 110 can be used with one or more urging members, such as springs 130. To achieve long travel of at least 5/8", it is preferably to reduce the spring solid height from that used in prior designs. This is because prior spring designs would have gone solid before 5/8" of travel was achieved. That is, the individual spring coils would have compressed against each other so that no further compression was possible.

Although two springs per side bearing are described in the embodiments, the invention is not limited to this and fewer, or even more, springs could be used. In fact, the number and size of springs may be tailored for a particular application. For example, lighter cars will use a softer spring rate and may use softer springs or fewer springs. Similarly, multi-unit articulated cars may use lighter or fewer springs because such cars use four side bearings instead of two per truck. As such, the load carrying capacity of each must be reduced. Also, it has been found that better performance can be achieved through use of substantially stiffer spring constants than previously used. This has been found to provide a suspension system with a slower reaction time, which has been found to achieve improved tracking and curving, without adversely affecting hunting. This has been found to result in reduced sensitivity to set-up height variations or component tolerances so as to achieve a more consistent preload on the truck system. This tends to equalize the loading and allow a railcar to stay more level, with less lean or roll both statically and dynamically.

To obtain longer fatigue life, the material used for base 110 and cap 120 can be Grade E steel or cast iron. To assist in longer service life, hardened wear surfaces are provided on the inside surfaces of base wall 116.

Additionally, in an exemplary preferred embodiment, to prevent excessive movements and accelerated wear, reduced longitudinal clearances between cap 120 and base 110 are provided by reducing the tolerances from prior values. This can be achieved, for example, by more closely controlling the casting or other formation process of the cap 120 and base 110 side walls 116. In a preferred embodiment, base 100 has a longitudinal distance of 7.000" (+0.005/−0.015) between inside surfaces of side wall 116 and outside surfaces of side wall 121 of cap 120 have a longitudinal distance of 7.031" (+0.000/−0.020). This results in a closely controlled combined longitudinal spatial gap having a minimum of 0.006" and maximum of 0.046". The minimum is achieved when base side wall 116 is at the maximum tolerance of 7.005" and cap side walls 121 are at the minimum tolerance of 7.011." The maximum is achieved when the base side wall 116 are at the minimum tolerance of 6.985" and the cap side walls 121 are at the maximum tolerance of 7.031."

Figure 5:
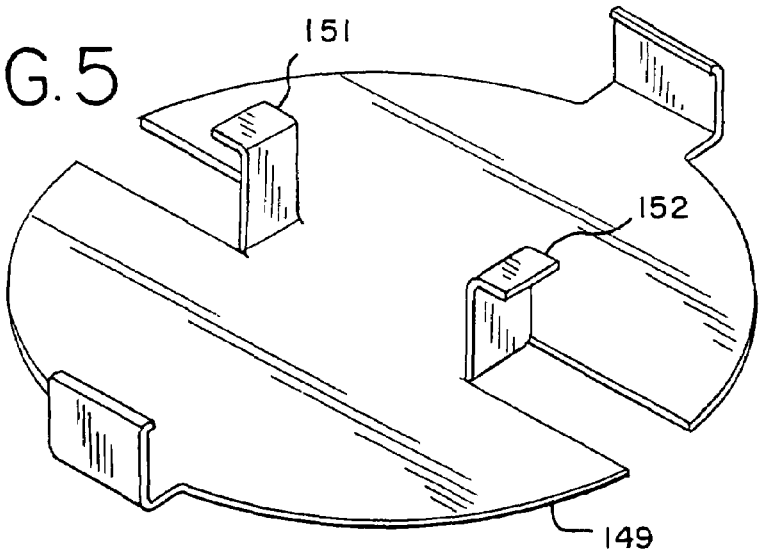
FIG. 5 is a perspective view of a spring base in accordance with an embodiment of the present invention.
Figure 6:
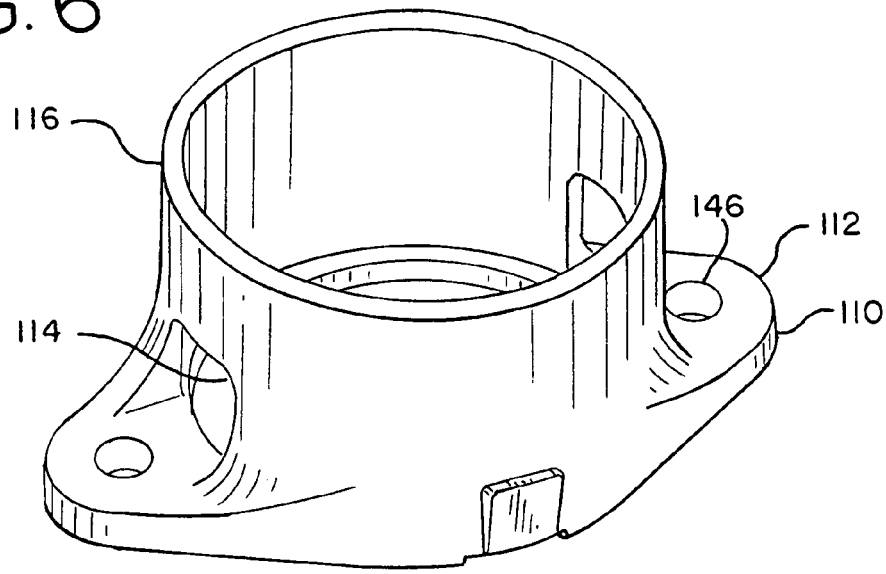
FIG. 6 is a perspective view of a first exemplary constant contact side bearing base according to the invention.
Figure 7:
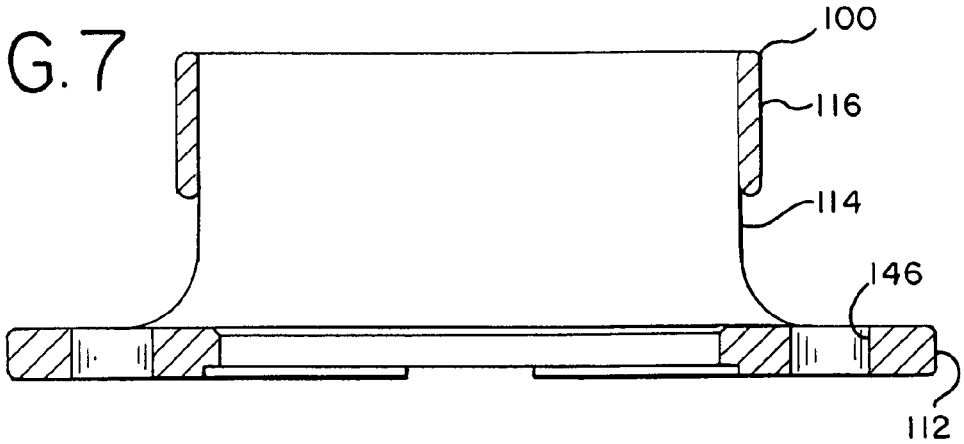
FIG. 7 is a cross-sectional view of the first exemplary side bearing base.
Figure 8:
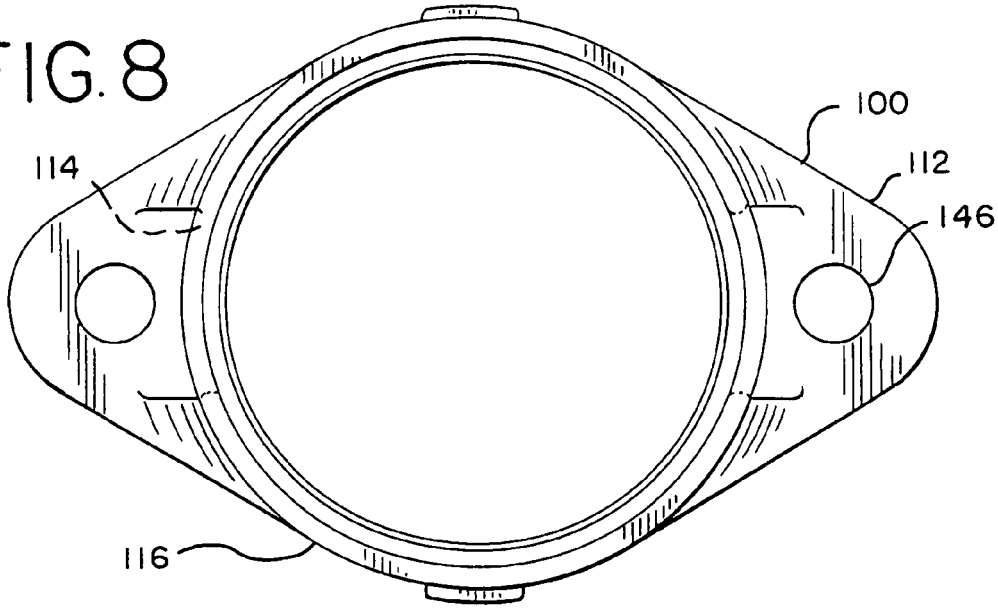
FIG. 8 is a top view of the first exemplary side bearing base.
Figure 9:
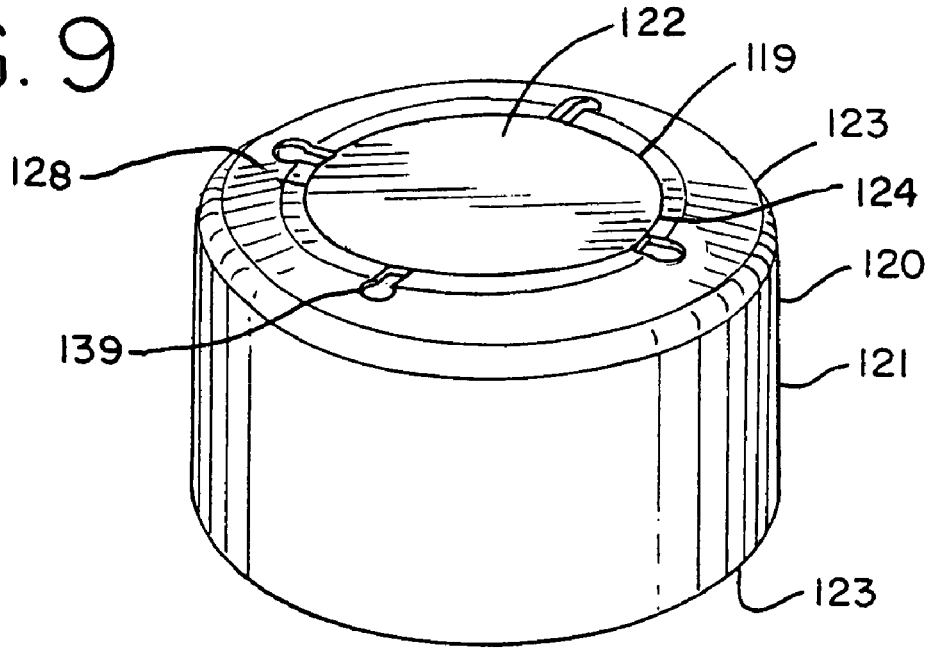
FIG. 9 is a perspective view of the exemplary side bearing cap with a non-metallic insert according to the invention.
Figure 10:
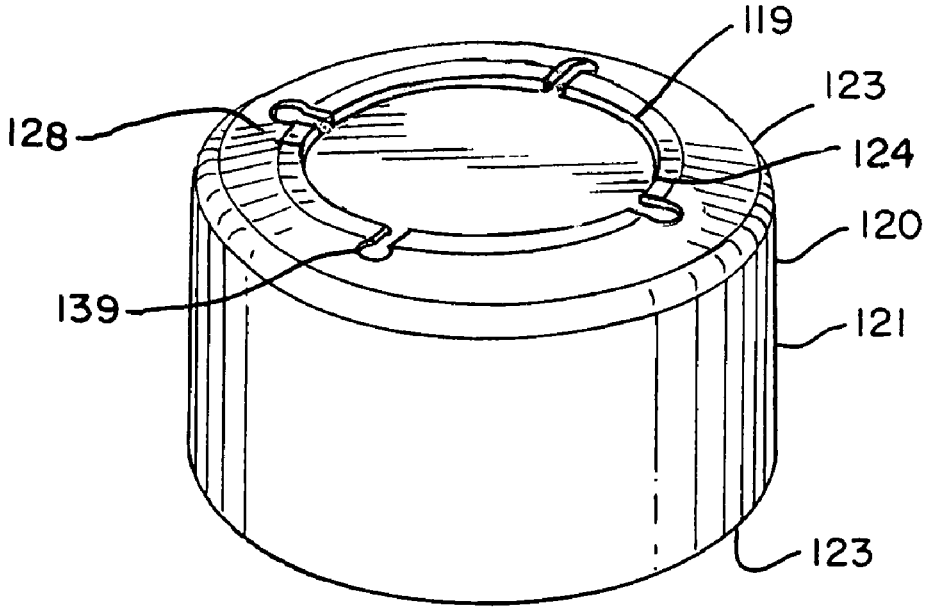
FIG. 10 is a perspective view of the exemplary side bearing cap without a non-metallic insert according to the invention.

Further, base 110 is seen to have a generally cylindrical opening 147 that is centrally located between flange 112. As shown in FIG. 5, a spring base 149 is located in cylindrical opening 147. Spring base 149 is generally circular, with two identical spring supports 151, 152 extending upwardly from a near center location. Spring supports 151, 152 are raised formed siding the inner support spring 130A. These supports are located to reject springs not included in the correct group for the preload specified on the identification tab 153. Spring base 149 is usually a fabricated steel component.

What is claimed is:

1. A side bearing for use in a railway car truck, comprising: a base section having a bottom section and a cylindrical raised section, a cup-shaped cap having a circular top section and a downwardly extending cylindrical wall section that extends into the cylindrical raised section of the base section in a telescoping fashion with a predetermined spatial gap therebetween; and at least one coil spring provided within the base section extending between the base section and the cap, the coil spring having load rating of less than about 6,000 lb/in, and a travel length from a loaded static height to a fully compressed solid height of at least ⅝", wherein the walls of the cap and base are configured so as to retain an overlap at the loaded static height state and allow least ⅝" of spring travel length before parts of the cap and base section abut each other and prevent further spring travel, wherein an interior portion of the cylindrical raised section of the base section and an exterior portion of the cylindrical wall section of the cap have a complementary elongated, vertically extending ridge and opening which prevent rotation of the cap within the base section, and wherein the cup-shaped cap includes a generally centrally located cut out section, and an elastomer insert within the cut out section, and the elastomer extends above the cut out section.

2. The side bearing of claim 1, wherein the cut out section of the cap is generally circular in shape, and has a depth of about 0.187 inch and the elastomer insert has a height of about 0.025 inch.

3. The side bearing of claim 1, wherein the elastomer insert is comprised of a combination of carbon, rubber and strengthening fibers and is mold formed.

4. The side bearing of claim 1, wherein the generally cylindrical wall section of the cap is surface coated with an impregnated graphite lubricant.

5. The side bearing of claim 1, wherein the generally cylindrical wall section of the cap is surface coated with titanium nitride.

6. The side bearing of claim 1, wherein the top surface of the cap includes a substantially flat surface that is generally centrally located and rounded edges extending from the substantially flat surface to the generally cylindrical wall section of the cap, and the cut out section is located generally centrally in the generally flat surface of the top surface of the cap.

7. The side bearing of claim 1, wherein the cap and base section are formed from Austempered Ductile Iron, and the wall section of the cap is coated with titanium nitride.

8. The side bearing of claim 1, wherein two or more coil springs are provided within the base section, each having a different diameter, the two or more coil springs each having a spring load rating sufficiently low that the combined spring load rating is between about 2,500 to 4,000 lb/in.

9. The side bearing of claim 1, further including a spring base located within an opening in the bottom section of the base section.

10. A side bearing for use in a railway car truck, comprising: a base having a bottom section and an upwardly extending cylindrical raised section, a cup-shaped cap having a circular top section and a downwardly extending cylindrical wall section that extends into the raised section of the base in a telescoping fashion with a predetermined spatial gap therebetween precisely controlled to be between about 0.006 in. to 0.046 in. and at least one resilient spring member provided within the base extending between the base and the cap, the at least one urging member having a combined load rating between about 2,500 to 4,000 lb/in, and a travel length from a loaded static height to a fully compressed solid height of at least ⅝ in., wherein the wall of the cap and base are configured so as to retain an overlap at the loaded static height state and allow at least ⅝ in. of spring travel length before parts of the cap and base abut each other and prevent further travel, wherein an interior portion of the cylindrical raised section of the base section and an exterior portion of the cylindrical wall section of the cap have a complementary elongated, vertically extending ridge and opening which prevent rotation of the cap within the base section, and wherein the cup shaped cap includes a generally centrally located cut out section, and an elastomer insert within the cut out section, and the elastomer extends above the cut out section.

11. The side bearing of claim 10, wherein the cut out section of the cap is generally circular in shape, and has a depth of about 0.187 inch and the elastomer insert has a height of about 0.25 inch.

12. The side bearing of claim 10, wherein the elastomer insert is comprised of a combination of carbon, rubber and strengthening fibers and is mold formed.

13. The side bearing of claim 10, wherein the generally cylindrical wall section of the cap is surface coated with an impregnated graphite lubricant.

14. The side bearing of claim 10, wherein the generally cylindrical wall section of the cap is surface coated with titanium nitride.

15. The side bearing of claim 10, wherein the resilient spring member includes at least one coil spring.

16. The side bearing of claim 10, wherein the top surface of the cap includes a substantially flat surface that is generally centrally located and rounded edges extending from the substantially flat surface to an outer surface of the generally cylindrical wall section of the cap, and the cut out section is located generally centrally in the generally flat surface of the top surface of the cap.

17. The side bearing of claim 10, wherein two or more coil springs are provided within the base section, each having a different diameter, the two or more coil springs each having a spring load rating sufficiently low that the combined spring load rating is between about 4,000 to 6,000 lb/in.

18. The side bearing of claim 10, further including a spring base located within an opening in the bottom section of the base section.

19. The side bearing of claim 10, wherein further including a spring base located within an opening in the bottom section of the base section.

20. A side bearing for use in a railway car truck, comprising: a base having a bottom section and a cylindrical raised section, a cup-shaped cap having a circular top section and a downwardly extending cylindrical wall section that extends into the raised section of the base section in a telescoping fashion with a predetermined spatial gap therebetween precisely controlled to be between about 0.006 in. to 0.046 in. to improve control and hunting characteristics of the railway car truck, the top surface of the cap including a substantially flat surface that is generally centrally located and rounded edges extending from the substantially flat surface of the outer surface of the generally cylindrical wall section of the cap, at least one coil spring provided within the base extending between the base and the cap, the at least one coil spring having a combined load rating between about 2,500 to 4,000 lb/in, and a travel length from a loaded static height to a fully compressed solid height of at least ⅝ in., wherein the walls of the cap and base are configured so as to retain an overlap at the loaded static height state and allow at least ⅝ in. of spring travel length before parts of the cap and base abut each other and prevent further spring travel, wherein an interior portion of the cylindrical raised section of the base section and an exterior portion of the cylindrical wall section of the cap have a complementary elongated, vertically extending ridge and opening which prevent rotation of the cap within the base section, and wherein the base includes first openings on the bottom section and corresponding second openings in the wall section to allow wrench access to bolt heads in the first openings in the bottom section, and wherein the cup shaped cap includes a generally centrally located cut out section, and an elastomer insert within the cut out section, and the elastomer extends above the cut out section.

21. The side bearing of claim 20, wherein the cut out section of the cap is generally circular in shape, and has depth of about 0.187 inch and the elastomer insert has height of about 0.25 inch.

22. The side bearing of claim 20, wherein the elastomer insert is comprised of a combination of carbon, rubber and strengthening fibers and is mold formed.

23. The side bearing of claim 20, wherein the generally cylindrical wall section of the cap is surface coated with an impregnated graphite lubricant.

24. The side bearing of claim 20, wherein the generally cylindrical wall section of the cap is surface coated with titanium nitride.

* * * * *